United States Patent [19]

Dijkhuis

[11] 4,330,399

[45] May 18, 1982

[54] MAGNETIC SEPARATION METHOD

[75] Inventor: Jacob I. Dijkhuis, TC Zeist, Netherlands

[73] Assignee: Holec N.V., Utrecht, Netherlands

[21] Appl. No.: 222,158

[22] Filed: Jan. 2, 1981

[30] Foreign Application Priority Data

Jan. 10, 1980 [NL] Netherlands ..... 8000165

[51] Int. Cl.[3] ..... B03C 1/00

[52] U.S. Cl. ..... 209/214; 209/11; 209/232; 44/51

[58] Field of Search ..... 209/11, 214, 223 R, 209/232; 44/15 R, 51; 406/197

[56] References Cited

U.S. PATENT DOCUMENTS

| | | | |
|---|---|---|---|
| 3,180,691 | 4/1965 | Wunsch et al. | 209/172 X |
| 3,503,504 | 3/1970 | Bannister | 209/232 X |
| 3,730,201 | 5/1973 | Lefever | 406/197 |
| 3,968,999 | 7/1976 | Keller | 406/197 |
| 4,239,619 | 12/1980 | Aplan et al. | 209/214 |

FOREIGN PATENT DOCUMENTS

| | | | |
|---|---|---|---|
| 698657 | 11/1979 | U.S.S.R. | 209/11 |

*Primary Examiner*—Ralph J. Hill

*Attorney, Agent, or Firm*—Silverman, Cass & Singer, Ltd.

[57] ABSTRACT

A method of separating more magnetic particles from less magnetic particles, contained in a fluid medium which is subjected to a magnetic field, in which as fluid liquified gas is used.

8 Claims, 1 Drawing Figure

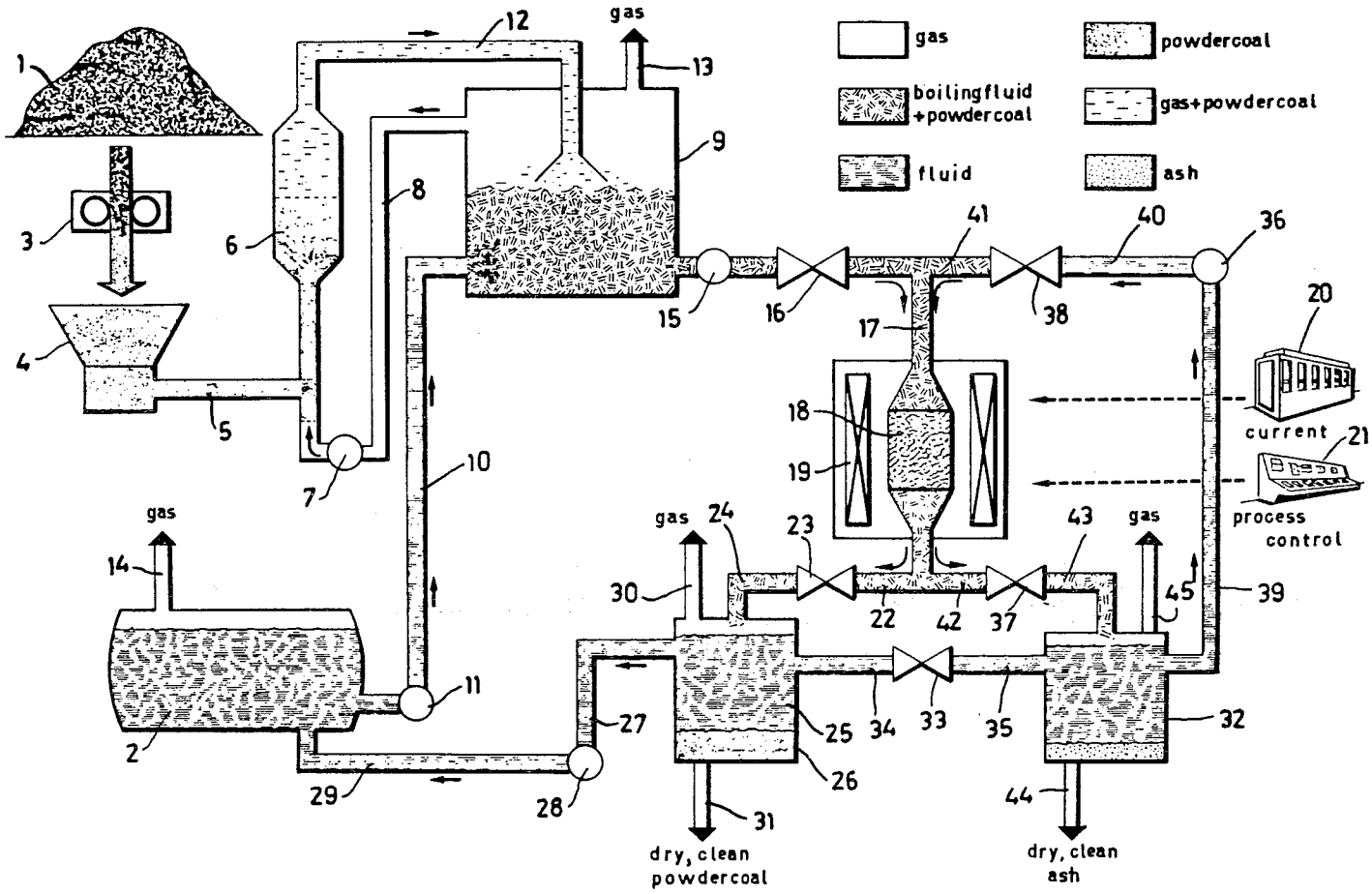
powdercoal
gas+powdercoal
ash
gas
boilingfluid +powdercoal
fluid
current
process control
gas
dry, clean ash
dry, clean powdercoal
gas
gas
gas

MAGNETIC SEPARATION METHOD

FIELD OF THE INVENTION

The present invention relates to a method of separating more magnetic particles from less magnetic particles contained in a fluid medium which is subjected to a magnetic field.

BACKGROUND OF THE INVENTION

The method as outlined above is commonly used for cleaning kaolien and metal ore. The filter element of such a separator is, e.g., steelwool which is subjected to a magnetic field of high intensity; the difference in magnetic properties results in that, dependent upon the field strength, the velocity and viscosity of the fluid and of the temperature certain particles are caught in the steelwool, and others are not.

This method is e.g. described in IEEE Transactions on Magnetics, Vd. Mag-12, no. 5, September 1976 and in the U.S. Pat. Nos. 3,887,457 and 3,988,240.

It is known in itself that of many paramagnetic particles the magnetic susceptibility ($X=M/H$) is temperature-dependent, and inversally proportional to the absolute temperature (°K.). It is to be expected that the method as described above will be more effective at lower temperatures than at higher temperatures, but until now the separation method is not carried out at low temperatures because cooling the separator to a sufficient low temperature is very costly and requires a complex and costly structure.

SUMMARY OF THE INVENTION

It is therefore an object of the present invention to provide an improved and inexpensive method of magneticaly separating more magnetic particles contained in a fluid from less magnetic particles.

It is a further object of the invention to provide a method which makes it economicaly feasable to remove impurities from powdered coal, resulting in a cheap fuel of excellent properties the burning if which does not pollute the environment.

The present invention results from the realisation that the known method can be effected at a low temperature in an economical and simple way when one uses as fluid liquified gas. The advantages of using liquified gas as the fluid are many. When the fluid has passed the filter the gas can be easily separated from the cleaned and filtered material by letting the gas phase off at ambient temperature. The viscosity of the fluid phase is low, so that small viscose forces act upon the particles which are to separated which means that for a given magnetic field strength the velocity of the fluid through the separator can be higher. The capacity of the separator will be greater and the pressure drop across the separator will be smaller; a low capacity pump can be used and the particles will precipitate faster in a pre-separator when such a separator is used. When a mechanic filter is used for preliminary filtering, the pressure drop across this filter, too, will be smaller.

It is possible to construct the separator in such a way that heat can leak in or that heat can be applied to the fluid, so that the fluid will boil. Then there is no need for using agitators. When cryogenic liquified gases are used the magnetization of the particles will be higher resulting in a higher efficiency; the gases themselves can be used as coolant for the winding of the magnet so that the losses therein will be lower and less power is used.

When a superconducting magnet is used the liquified gas can be used as a heat shield around the space which contains the magnet.

Various liquified gases can be used, such as LNG, $LH_2$, $LO_2$ and $LN_2$.

The invention is preferably accomplished by a method in which coal is mixed with a liquified reactive gas, the coal in this mixture is powdered so that a slurry is formed from the powdered coal and the liquified gas, whereafter this slurry is supplied to the magnetic separator and the resulting slurry is supplied to the magnetic separator and the resulting slurry of clean powder coal and liquified reactive gas is discharged.

The thus obtained fuel, comprising liquified reactive gas and clean powdercoal is excellently suited to be used in a burner, where, as the "fuel" will boil, a thorough mixing of the components will take place so that the efficiency of the burner will be high and no external energy supply to the burner is necessary .

Particular advantages are obtained when the fluid is liquified natural gas (LNG).

In the total world energy production liquified natural gas plays an ever increasing role; there where it is found it is obtained at temperatures between −160° and 170° C.

When liquified natural gas is used the coal can be mixed therewith and powdered and the components form a slurry which is supplied to the magnetic separator; the escaping liquified natural gas can be supplied to the gas distributing network and the slurry of liquified natural gas and cleaned powdered coal, supplied by the separator is discharged. Coal is also becoming increasingly important but the coal which is presently being mined is of a relatively low quality, contains a lot of impurities and pollutes the environment. Cleaning raw coal must be done in very costly and big installations and is as such economically very unattractive, but the use of uncleaned raw coal in electrical energy plants makes it necessary to use very costly fly-ash filters in the discharge ducts of the exhaust gases and leads to pollution of the air, particularly with sulphur compounds. The method as outlined above makes it economically feasible to remove to very high extent impurities from the slurry of powdercoal and liquified natural gas, resulting into clean liquified natural gas which can be supplied directly to the distribution network and a slurry of clean powdered coal and liquified natural gas. This slurry can be used directly as fuel with all the advantages thereof as outlined above but it is also possible to let the liquified natural gas evaporate from this slurry and supply it to the distribution network, and to use the resulting clean powdercoal as fuel. The powdercoal contains practically no impurities so that it is not only unnecessary to remove sulphurcompounds from the exhaust gases after the burning of the powdered coal when the amount of organically bounded sulphur is small (the pyrite contents of the powdercoal is, as compared with normally obtained powdered coal, very low) but as the total ash production is also low the complete installation can be much simplier and cheaper.

DISCLOSURE OF PREFERRED EMBODIMENT

Other objects, features and embodiments will occur from the following description of a preferred embodiment and the accompanying drawing, which shows schematically a complete installation for carrying out the method according to the present invention.

Starting from a coal supply indicated schematically with the reference numeral 1, and from liquified natural gas, present in a schematically indicated supply container 2 the coals 1 are powdered by the, schematically indicated, grinding device 3 and the thus obtained powdered coal is supplied to a metering device 4 which is connected through the conduit 5 to a whirlbed 6 in which a gas current is maintained by the compressor 7 which supplies, through the conduit 8, gas which is discharged from the mixing vessel 9. To this mixing vessel 9 cold gas is supplied through the conduit 12 and the compressor 7, and liquified gas is supplied from the supply container 2. The mixing vessel 9 is partly filled with boiling liquid gas; the boiling results from the fact that through the conduit 12 powdered coal is discharged from the fluidizing bed 6 into the mixing vessel 9 which powdered coal has a higher temperature than the liquified gas, supplied through the conduit 10. This boiling results into an excellent mixing of the powdercoal and the liquid; part of the gas, which escapes, is supplied through the conduit 8 and the compressor 7 to the whirlbed 6 and part is discharged through the conduit 13. Gas also escapes through the conduit 14 from the supply 2.

The heat content of the evaporated gases can be used to cool the powdered coal when the gas is a cryogenic liquified gas.

The boiling mixture is supplied through the pump 15, the valve 16 and the conduit 17 to the magnetic separator 18, which, as known in itself, has a magnetizing winding 19 which is energized by the schematically indicated electrical supply 20. The operation of this separator and the complete installation is controlled by the, also schematically indicated, process control 21.

The actual magnetic field strength in the separator depends upon the composition of the coal; the field strength can be as 12 Tesla. At lower intensities of the magnetic field, e.g. up till 2 Tesla, a normal electromagnet with an iron core can be used of which the winding can be cooled by the liquified gas when this is a cryogenic fluid. As a result the ohmic losses and the heat dissipation will be low.

At higher intensities of the magnetic field a superconducting magnet can be used, e.g. cooled with helium, and then the cryogenic fluid can be used as a heat shield.

When the mixture flows through the separator 18 the magnetic particles thereof, such as ash and pyrite remain in the matrix of the separator while non-magnetic particles, to wit the clean powdered coal are discharged through the conduits 22, the valve 23 and the conduit 24 to the precipitating vessel 25.

In this precipitating vessel 25 pressure and temperature are controlled such that the fluid does not boil, so that the clean powdered coal 26 will precipitate and can be discharged, after which the gas contained therein can be allowed to escape, and the coal is brought to ambient temperature; however, it is also possible to discharge the mixture of liquified gas (when this gas is a reactive gas such as LNG, $LH_2$, $LO_2$, LPG) and coal as such, and use this mixture as fuel for a burner.

The figure shows how the liquified gas can be carried back through the conduit 27, the compressor 28 and the conduit 29 to the supply vessel 2; the discharge from gas from the precipitating vessel 25 is effected through the conduit 30 and the discharge of powder coal is by the, schematically indicated, conduit 31.

After a certain operating time the matrix of the separator 18 will be saturated and must be cleaned. Then first the valve 16 between the mixing vessel 9 and the separator 18, as well as the valve 23 between the separator 18 and the precipitating vessel 25 are closed, and then the strength of the magnetic field is reduced. Thereafter a washing circuit is put into operation; this circuit comprises the ash precipitation vessel 32, containing liquified gas in which the ash can precipitate, and in which the temperature and pressure are controlled such that the fluid does not boil. The fluid level in this vessel can be controlled by means of the valve 33 between the conduits 34 and 35 which interconnect the powdercoal precipitating vessel 25 and the ash precipitating vessel 32. When the compressor 36 is actuated and the valves 37 and 38 are opened, the separator matrix is cleaned by fluid flowing through the conduits 39, 40, 41, 17, 42 and 43; a mixture of liquified gas and ash is then fed into the ash precipitating vessel. Ash is removed after the precipitating through the discharge conduit 44 and the gas, which was present in the discharged mixture, is removed. This gas can then be recycled and reintroduced in the installation.

However, the separator can also be cleaned by means of a gas current and then the ash can be removed from the gas in a centrifugal separator.

A gas discharge conduit 45 is connected to the precipitating vessel; the gas can be discharged into the open air or supplied to a distributing network; as an alternative it can be liquified and supplied to the supply vessel 2.

It is clear that by means of a suitable process-control the various temperatures and pressures, coal supply, gasvelocity and the velocity of the gas-powder-coal mixture, the velocity of the fluid and the boiling fluid, as well as the control of the valves and the intensity of the magnetic field will all be controlled in such a way that the complete installation will operate with an efficiency which is as high as possible. Such a process control lies within reach of the expert and need not be described. The coal can be powdered after it is mixed with the liquified gas, which is advantageous as at a lower temperature coal is more brittle so that the powdering thereof will take less energy.

A continuous process is possible by using the known technics of removing a saturated filtermatrix from the separator and replacing it by a cleaned filtermatrix, e.g. using a carossel structure, and cleaning the saturated filtermatrix outside the magnetic circuit of the separator.

While a particular embodiment of the present invention has been illustrated and described herein, it will be understood that this invention is not limited thereto, but is susceptible to change in form and detail.

What is claimed is:

1. A method of separating more magnetic particles from less magnetic particles on the basis of their respective magnetic properties comprising the steps of mixing a mixture of said particles with a liquified reactive gas to form a slurry thereof; subjecting said slurry to a magnetic field at a temperature at which said liquified reactive gas remains liquid; and, magnetically separating the more magnetic particles from said slurry under the influence of said magnetic field.

2. A method according to claim 1 in which a magnetic circuit separator is provided and the step of simultaneously cooling the magnetic circuit of the separator with the liquified reactive gas.

3. A method according to claim 1, in which a shielded magnetic circuit having supraconducting properties is provided and the step of cooling the shielding around the magnetic circuit with said liquified reactive gas.

4. A method of removing impurities having paramagnetic properties from coal comprising the steps of mixing raw coal with a liquified reactive gas; powdering the coal; forming a slurry from the powdered coal and the liquified gas, feeding the slurry of powdered coal and liquified reactive gas to a magnetic separator to separate the paramagnetic impurities therefrom; and discharging the resulting slurry of clean powdered coal and liquified reactive gas.

5. A method according to claim 4, in which the liquified reactive gas is liquified natural gas.

6. A method according to claim 4 and the step of permitting the liquified gas to escape from said slurry subsequent to magnetic separation; supplying the said gas to a gas distributing network and discharging the resulting powdered coal as an endproduct.

7. A method according to claim 4 and the step of using the boiling liquified reactive gas to transport the solid particles and separating the solid particles gravitationally from the liquified gas under conditions where the liquified gas is hardly boiling.

8. A method according to claim 4 and the step of using liquified reactive gas which is free of paramagnetic impurities to transport the solid particles and separating the solid particles gravitationally from the liquified gas under conditions where the liquified gas is not boiling.

* * * * *